US005458510A

United States Patent [19]

Nager, Jr. et al.

[11] Patent Number: 5,458,510

[45] Date of Patent: Oct. 17, 1995

[54] PRINTED CIRCUIT BOARD CONNECTOR CONTACT

[75] Inventors: Urs F. Nager, Jr., Hudson, N.H.; Richard L. Eby, Marshfield, Mass.

[73] Assignee: High Voltage Engineering Corporation, Wakefield, Mass.

[21] Appl. No.: 161,898

[22] Filed: Dec. 3, 1993

[51] Int. Cl.[6] ..... H01R 13/40

[52] U.S. Cl. ..... 439/733.1

[58] Field of Search ..... 439/733, 79, 885

[56] References Cited

U.S. PATENT DOCUMENTS 3,129,814 4/1964 Cheh et al. ..... 439/885 X 4,755,336 10/1988 Paulo ..... 439/885 X 5,071,372 12/1991 Viselli et al. ..... 439/733

*Primary Examiner*—Eugene F. Desmond

*Attorney, Agent, or Firm*—Richard J. Birch

[57] ABSTRACT

An integrally formed, longitudinally extending, generally planar electrical contact has an arcuate, contact engaging forward portion, a rear, tail end portion and an intermediate portion with an upwardly extending contact housing engaging member and at least one downwardly extending contact positioning member. The electrical contact is designed to fit into a housing to produce a genderless electrical connector.

13 Claims, 4 Drawing Sheets

PRINTED CIRCUIT BOARD CONNECTOR CONTACT

BACKGROUND OF THE INVENTION

The present invention relates to electrical connectors in general, and more particularly, to an electrical contact for use in a genderless electrical connector on a printed circuit board.

Genderless electrical connectors are well known in the art. One example of such a connector is described in U.S. Pat. No. 3,259,870 issued Jul. 5, 1966 to Edward D. Winkler for Electrical Connector. The subject matter of U.S. Pat. No. 3,259,870 is incorporated herein in its entirety by reference. The Winkler electrical connector employs a rigid terminal member or contact that is attached to a wire lead by soldering or crimping. The terminal member itself is not suitable for use with a printed circuit board.

It is, accordingly, a general object of the invention to provide an electrical contact that can be used in conjunction with a printed circuit board.

It is a specific object of the invention to provide an electrical contact for a genderless electrical connector that can be used with a printed circuit board.

It is another object of the invention to provide an integrally formed electrical connector for use with a printed circuit board.

SUMMARY OF THE INVENTION

An integrally formed, longitudinally extending, generally planar electrical contact has an arcuate contact engaging forward portion, a rear, tail end portion and an intermediate portion with an upwardly extending contact housing engaging member and at least one downwardly extending contact positioning member. The electrical contact can be used in place of the terminal contact of U.S. Pat. No. 3,259,870.

BRIEF DESCRIPTION OF THE DRAWINGS

The objects and features of the invention will best be understood from a detailed description of a preferred embodiment, selected for purposes of illustration, and shown in the accompanying drawings in which.

DESCRIPTION OF A PREFERRED EMBODIMENT

Figure 1:
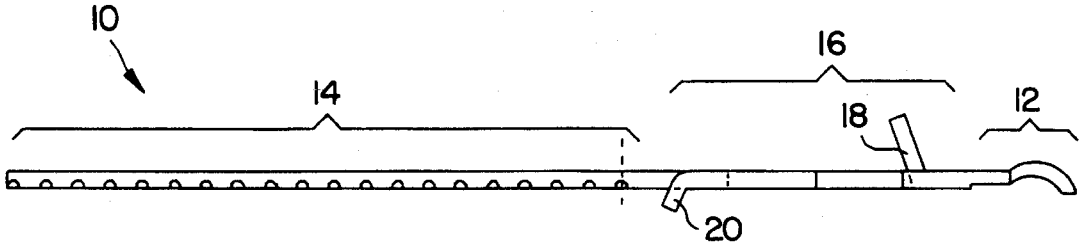
FIG. 1 is a view in side elevation of an electrical contact constructed in accordance with the present invention.
Figure 2:
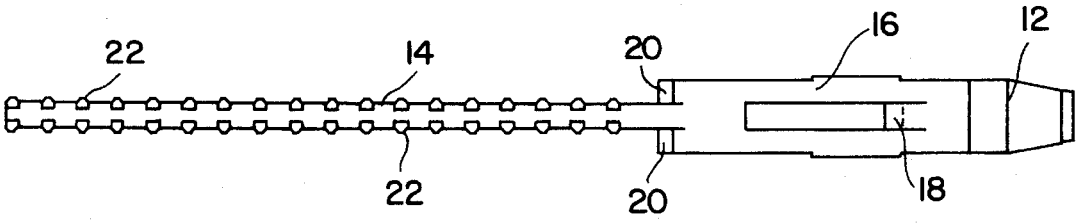
FIG. 2 is a plan view of the electrical contact shown in FIG. 1.

Turning now to the drawings, and particularly to FIGS. 1 and 2 thereof, there is shown in side elevation and plan view, respectively, an electrically conductive electrical contact constructed in accordance with the present invention and identified generally by the reference numeral 10. The electrical contact 10 is an integrally formed, longitudinally extending contact having an arcuate contact engaging front end portion 12, a rear, tail end portion 14, and intermediate portion 16 having an upwardly extending contact housing engaging member 18 and at least one downwardly extending contact positioning member 20.

It should be understood that the terms "upwardly", "downwardly", "horizontal" and "vertical" are employed herein for descriptive purposes only and should not be construed as limiting the structure of the electrical contact 10 to a specific orientation with respect to the gravity vector.

Figure 3:
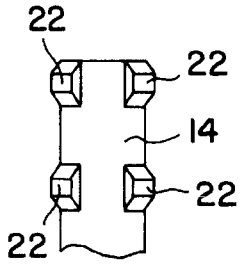
FIG. 3 is an enlarged view of a portion of the electrical contact of FIGS. 1 and 2 showing barbs on the tail end of the electrical contact.
Figure 4:
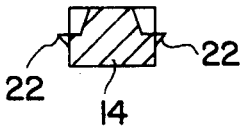
FIG. 4 is an enlarged view in partial section taken along line 4—4 in FIG. 2 showing the barbs.
Figure 5:
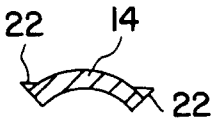
FIG. 5 is an enlarged view in partial section of an alternative curved configuration for the tail end of the electrical contact.
Figure 6:
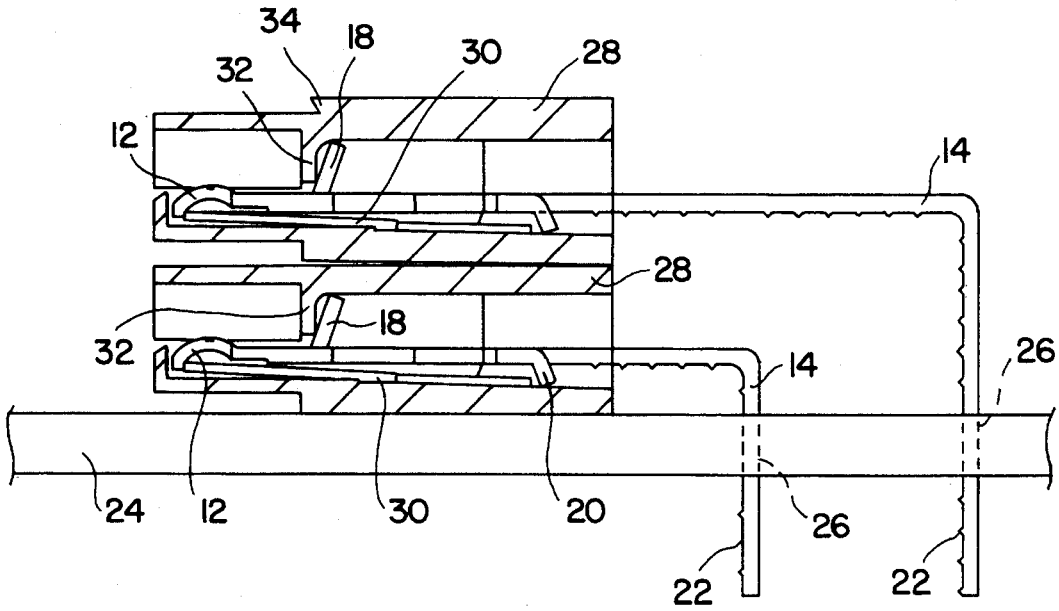
FIG. 6 is a view in partial section showing two electrical connectors with the electrical contact of FIGS. 1 and 2 positioned thereon and electrically connected to a printed circuit board.

Preferably, the rear, tail end portion 14 of the electrical contact 10 has a plurality of transversely extending barbs 22 as shown in enlarged detail in FIGS. 3 and 4 and in the alternative arcuate configuration of the tail portion 14 as shown in FIG. 5. The barbs provide for frictional engagement with a printed circuit board 24 as shown in FIG. 6. The frictional engagement is achieved by having the transverse dimension of a pair of barbs slightly greater than the diameter of the lead hole 26 in the printed circuit board 24.

As previously mentioned, the electrical contact 10 can be used in the electrical connector housing described in U.S. Pat. No. 3,259,870. The housing of the '870 patent is shown in FIG. 6 and identified by the reference numeral 28. The housing 28 contains a leaf-spring 30 that is staked to the housing and engages the undersurface of the arcuate front end portion 12 of the electrical contact 10. The contact housing 28 contains a transversely extended wall portion 32. The upwardly extending contact housing member 18 abuts the wall 32 and prevents the electrical contact from moving to the left and out of the contact housing as viewed in FIG. 6. The combination of the upstanding member 18 and leaf-spring 30 securely position the forward and intermediate portions of the electrical contact within housing 28. The contact itself is maintained in a generally horizontal position by at least one, and preferably two, downwardly extending members 20.

Figure 7:
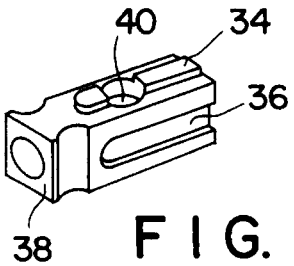
FIG. 7 is a view in perspective of a mounting adapter for the electrical connector of FIG. 5.
Figure 8:
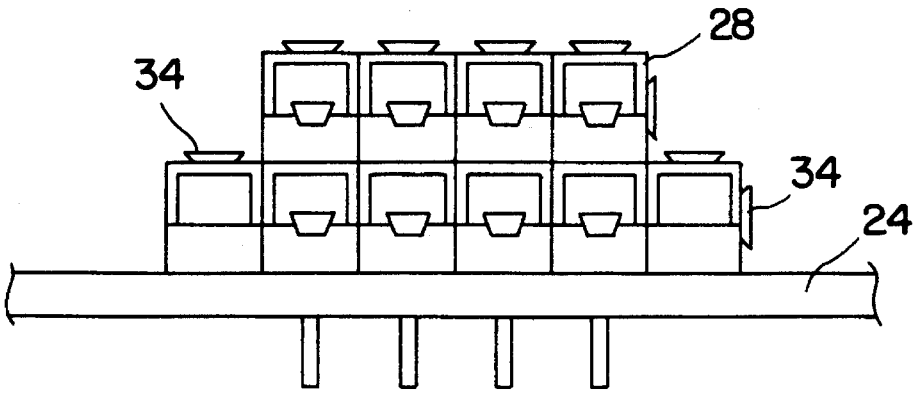
FIG. 8 is a view in front elevation illustrating a stacked assembly of electrical connectors each containing the electrical contact of FIGS. 1 and 2.
Figure 9:
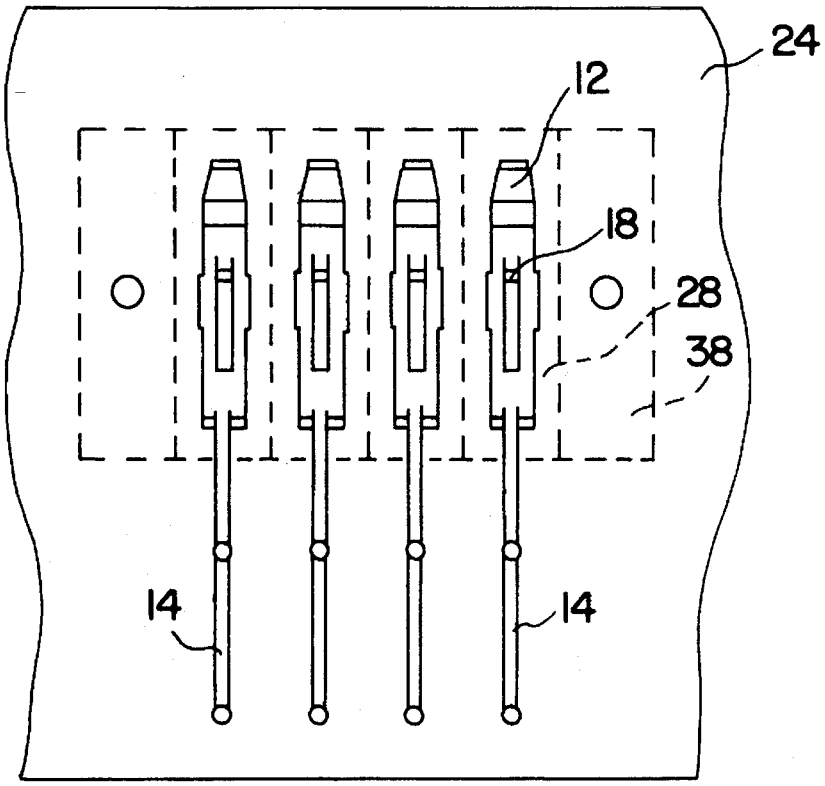
FIG. 9 is a view in plan of the electrical contacts of FIG. 6 with the electrical connector housing depicted by dashed lines; and, FIG. 10 is a plan view of a plurality of electrical contacts connected together by intermediate webs for use in automatic cutting and contact insertion machinery.

Referring to both FIGS. 6 and 7, the electrical connector housing of the '870 patent has interlocking dovetails 34 and grooves 36 for horizontally and vertically stacking a plurality of the electrical connector housings 28 as shown in FIGS. 8 and 9. In order to secure an assembled stack of connector housings to a substrate, such as a printed circuit board 24, a mounting adapter 38 having a fastener receiving through aperture 40 is employed. The mounting adapter 38 has corresponding male dovetails 34 and female grooves 36 for sliding engagement with a corresponding dovetail or groove of another electrical connector housing 28.

Figure 10:
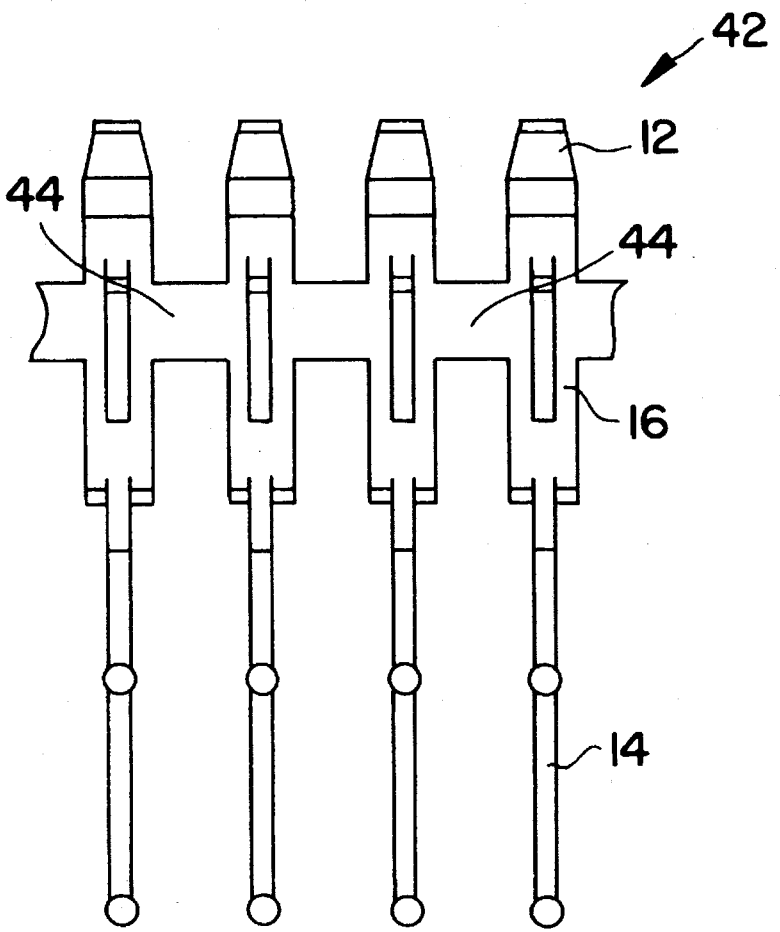

FIG. 10 illustrates in plan view an assembly 42 of the electrical contacts 10. The contacts 10 are connected together in spaced relation by a web 44. Preferably, the web 44 is integrally formed with the electrical contacts. This configuration is suitable for use with automatic cutting and contact insertion machinery.

Having described in detail a preferred embodiment of our invention, it will now be obvious to those having ordinary skills in the art that numerous modifications can be made therein without departing from the scope of the invention as defined in the following claims.

What we claim is:

1. An integrally formed, longitudinally extending, generally planar electrical contact having:

an arcuate, contact engaging forward end portion;

a rear, tail end portion; and, an intermediate portion having a contact housing engaging member extending upwardly away from the plane of the generally planar electrical contact and a contact positioning member extending downwardly away from the plane of the generally planar electrical contact.

2. The electrical contact of claim 1 wherein at least part of said rear, tail end portion has a transverse width less than the transverse width of the intermediate portion.

3. The electrical contact of claim 2 wherein said at least part of said rear, tail end portion has a plurality of barbs.

4. The electrical contact of claim 3 wherein said plurality of barbs extend transversely from said rear, tail end portion.

5. The electrical contact of claim 1 wherein said upwardly extending, contact housing engaging member slopes upwardly and rearwardly towards said rear, tail end portion of the electrical connector.

6. The electrical contact of claim 1 wherein said at least one downwardly extending contact positioning member slopes downwardly and rearwardly towards said rear, tail end portion of the electrical connector.

7. The electrical contact of claim 1 wherein said longitudinally extending electrical contact has a longitudinal axis and wherein said contact housing engaging member has the longitudinal axis passing therethrough.

8. An integrally formed, longitudinally extending., generally planar electrical contact having:

an arcuate, contact engaging forward end portion; a rear, tail end portion;

an intermediate portion having a contact housing engaging member extending upwardly away from the plane of the generally planar electrical contact;

a first contact positioning member extending downwardly away from the plane of the generally planar electrical contact; and, a second contact positioning member extending downwardly away from the plane of the generally planar electrical contact and being spaced transversely from said at least one downwardly extending contact positioning member.

9. The electrical contact of claim 7 wherein said rear, tail end portion extends rearwardly from between said two transversely spaced, downwardly extending contact positioning members.

10. An integrally formed, longitudinally extending, generally planar electrical contact having:

an arcuate, contact engaging forward end portion;

a rear tail end portion having at least a part thereof arcuate in transverse section with the concave portion of the arc facing downwardly away from the plane of said generally planar electrical contact; and, an intermediate portion having a contact housing engaging member extending upwardly away from the plane of the generally planar electrical contact and a contact positioning member extending downwardly away from the plane of the generally planar electrical contact.

11. An assembly of a plurality of electrical contacts with each contact comprising:

an integrally formed, longitudinally extending, generally planar electrical contact having:

an arcuate, contact engaging forward end portion;

a rear, tail end portion; and, an intermediate portion having a contact housing engaging member extending upwardly away from the plane of the generally planar electrical contact and a contact positioning member extending downwardly away from the plane of the generally planar electrical contact and;

web means for connecting at least two of said plurality of electrical contacts together in spaced apart relation.

12. The electrical contact assembly of claim 11 wherein said web means connects said at least two electrical contacts together at the intermediate portion thereof.

13. The electrical contact assembly of claim 11 wherein said web means is integrally formed with said at least two electrical contacts.

* * * * *